US011185115B2

(12) United States Patent
Fahey

(10) Patent No.: US 11,185,115 B2
(45) Date of Patent: Nov. 30, 2021

(54) SWIMWEAR WITH INTERCHANGEABLE ITEMS

(71) Applicant: Kim Fahey, Braintree, MA (US)

(72) Inventor: Kim Fahey, Braintree, MA (US)

( * ) Notice: Subject to any disclaimer, the term of this patent is extended or adjusted under 35 U.S.C. 154(b) by 0 days.

(21) Appl. No.: 16/139,603

(22) Filed: Sep. 24, 2018

(65) Prior Publication Data

US 2020/0093199 A1 Mar. 26, 2020

(51) Int. Cl.
*A41D 7/00* (2006.01)
*A41D 15/00* (2006.01)

(52) U.S. Cl.
CPC ..... *A41D 7/00* (2013.01); *A41D 15/00* (2013.01)

(58) Field of Classification Search
CPC ..... A41D 7/00; A41D 15/00
See application file for complete search history.

(56) References Cited

U.S. PATENT DOCUMENTS 443,390 A 12/1890 Caen
1,031,069 A * 7/1912 Hensley ..... A41C 1/06 450/14
1,092,696 A 4/1914 Curry
1,364,693 A 1/1921 Bonheur
1,664,214 A 3/1928 Hudson
1,814,451 A 7/1931 Neveu
1,954,526 A 4/1934 Holahan
1,969,333 A 8/1934 Steuer
2,016,664 A 10/1935 Brewster
2,019,996 A * 11/1935 Roth ..... A41C 1/06 450/14
2,022,621 A 11/1935 Ide
2,033,065 A 3/1936 Galligan
2,060,689 A 11/1936 Read
2,090,076 A 8/1937 Siegel
2,183,380 A 12/1939 Hurt
2,274,382 A 2/1942 Richman
2,290,638 A 7/1942 Englander
2,333,268 A 11/1943 Moon
2,335,658 A 11/1943 Fishbein
D136,860 S 12/1943 Walker
D138,422 S 8/1944 Mitchell
2,355,404 A 8/1944 Virden et al.
2,389,450 A 11/1945 Moy
2,390,462 A 12/1945 Rosenberg
2,412,502 A 12/1946 Garrison
2,429,767 A 10/1947 Oliensis
2,492,396 A 12/1949 Perlitch
2,493,545 A 1/1950 Muyleart
2,515,082 A 7/1950 Evans
(Continued)

FOREIGN PATENT DOCUMENTS

FR 768593 8/1934
GB 394555 6/1933
(Continued)

*Primary Examiner* — Khaled Annis

(57) ABSTRACT

In accordance with some embodiments, clothing ensembles are disclosed. In addition, swimsuit ensembles, and techniques for changing a style of a swimsuit ensemble, are disclosed. In accordance with some embodiments, a clothing ensemble is disclosed that includes a swimsuit top with attachment members, a swimsuit bottom, and a midriff garment with attachment members configured to attach to the attachment members of the swimsuit top.

15 Claims, 10 Drawing Sheets

(56) References Cited

U.S. PATENT DOCUMENTS

| | | | |
|---|---|---|---|
| 2,521,020 | A | 9/1950 | Prescott |
| 2,559,953 | A | 7/1951 | Evans |
| 2,561,783 | A | 7/1951 | Burr |
| 2,567,442 | A | 9/1951 | Mitchell |
| 2,632,177 | A | 3/1953 | Bigger |
| 2,703,885 | A | 3/1955 | Davis |
| 2,807,804 | A | 10/1957 | Miller |
| 2,808,590 | A | 10/1957 | Siegel |
| 2,857,600 | A | 10/1958 | Finn |
| 3,002,193 | A | 10/1961 | Briskman |
| 3,036,574 | A | 5/1962 | Jeffrey |
| 3,106,717 | A | 10/1963 | Cuvin |
| 3,166,076 | A | 1/1965 | Brown |
| 3,185,156 | A | 5/1965 | Steinberger |
| 3,212,503 | A | 10/1965 | Gorman |
| 3,306,299 | A | 2/1967 | Paramore |
| 3,311,112 | A | 3/1967 | Murray |
| 3,327,714 | A | 6/1967 | Steinberger |
| 3,654,630 | A | 4/1972 | Block |
| 3,740,765 | A | 6/1973 | Delplace |
| 3,771,172 | A | 11/1973 | Barg |
| 3,774,241 | A | 11/1973 | Zerkle |
| 3,939,845 | A | 2/1976 | Guidoni |
| D239,667 | S | 4/1976 | Bouchard |
| 3,961,376 | A | 6/1976 | Howell |
| 3,974,836 | A | 8/1976 | Carlson |
| 4,028,740 | A | 6/1977 | Luerken |
| 4,031,900 | A | 6/1977 | Guidoni |
| D249,096 | S | 8/1978 | Fowler |
| 4,154,249 | A | 5/1979 | Darring |
| 4,202,343 | A | 5/1980 | Ichelson |
| 4,227,264 | A | 10/1980 | Spector et al. |
| 4,301,545 | A | 11/1981 | Camarena |
| 4,306,317 | A | 12/1981 | Joseph |
| 4,528,699 | A | 7/1985 | Hughes |
| 4,656,669 | A | 4/1987 | Beard |
| 4,694,511 | A | 9/1987 | Estes et al. |
| 4,815,145 | A | 3/1989 | Chow |
| 4,853,977 | A | 8/1989 | Foreman |
| 4,917,651 | A | 4/1990 | Rainville |
| 4,999,848 | A | 3/1991 | Oney |
| 5,032,104 | A | 7/1991 | Rainville |
| 5,079,779 | A | 1/1992 | Spector et al. |
| 5,083,316 | A | 1/1992 | Kuehner |
| 5,163,182 | A | 11/1992 | Fiveash |
| 5,315,712 | A | 5/1994 | McTaggart |
| 5,331,685 | A | 7/1994 | Belgard |
| 5,367,709 | A | 11/1994 | Teasley |
| 5,398,343 | A | 3/1995 | Kuracina |
| 5,478,278 | A | 12/1995 | Greenblatt |
| 5,538,502 | A | 7/1996 | Johnstone |
| 5,561,858 | A | 10/1996 | Poirier |
| 5,678,246 | A | 10/1997 | Cooley et al. |
| 5,894,600 | A | 4/1999 | Chenefront |
| 5,987,650 | A | 11/1999 | Carroll |
| 5,991,920 | A | 11/1999 | Holland |
| 6,009,556 | A | 1/2000 | Nenninger |
| 6,016,569 | A | 1/2000 | Everett et al. |
| 6,035,439 | A | 3/2000 | Chin |
| 6,047,404 | A | 4/2000 | Blanks |
| 6,055,668 | A | 5/2000 | Gros et al. |
| 6,185,741 | B1 | 2/2001 | Kehoe |
| 6,223,352 | B1 | 5/2001 | Watlington |
| 6,240,560 | B1 | 6/2001 | DeCaro |
| 6,282,717 | B1 | 9/2001 | Ng |
| 6,336,840 | B2 | 1/2002 | Heroff |
| 6,374,412 | B1 | 4/2002 | Canlas |
| 6,665,882 | B1 | 12/2003 | Pedrick |
| 6,859,944 | B2 | 3/2005 | Kim |
| 7,077,720 | B2 | 7/2006 | Schneider et al. |
| 7,181,773 | B1 | 2/2007 | Piraka |
| 7,181,774 | B2 | 2/2007 | Silver |
| D544,678 | S | 6/2007 | Fitzgerald |
| 7,260,852 | B2 | 8/2007 | Sheetz |
| 7,340,780 | B2 | 3/2008 | Levy |
| 7,409,728 | B2 | 8/2008 | Harry |
| 7,448,090 | B2 | 11/2008 | Lucock |
| 7,553,213 | B2 * | 6/2009 | Smith ..... A41C 3/06 450/86 |
| 7,849,522 | B2 | 12/2010 | Roux |
| 8,051,496 | B2 | 11/2011 | Hersh |
| 8,075,366 | B1 * | 12/2011 | Jaksic ..... A41C 3/08 2/105 |
| 8,100,737 | B2 | 1/2012 | Deal |
| 8,316,464 | B2 | 11/2012 | Hersh |
| 8,402,567 | B2 | 3/2013 | Agassi et al. |
| 8,522,362 | B1 | 9/2013 | Stones et al. |
| 9,220,305 | B2 | 12/2015 | Hersh |
| 9,706,799 | B1 | 7/2017 | Butler |
| 2002/0088047 | A1 | 7/2002 | Greenblatt |
| 2002/0157165 | A1 | 10/2002 | Kroll |
| 2004/0098784 | A1 | 5/2004 | Desai |
| 2004/0142630 | A1 | 7/2004 | Lambru |
| 2004/0209018 | A1 | 10/2004 | Lookholder |
| 2005/0060792 | A1 | 3/2005 | Desai |
| 2006/0026734 | A1 | 2/2006 | Fitzgerald |
| 2006/0031976 | A1 | 2/2006 | Nwawka |
| 2006/0212987 | A1 | 9/2006 | Jao |
| 2007/0105481 | A1 | 5/2007 | Scholz |
| 2007/0266472 | A1 | 11/2007 | DuFaux |
| 2007/0281585 | A1 | 12/2007 | Calamari et al. |
| 2008/0141431 | A1 * | 6/2008 | Rance ..... A41D 7/00 2/67 |
| 2009/0126072 | A1 | 5/2009 | Allen |
| 2009/0320175 | A1 | 12/2009 | Shih |
| 2010/0058508 | A1 * | 3/2010 | Hersh ..... A41D 7/00 2/67 |
| 2010/0275946 | A1 * | 11/2010 | Ruschell ..... A41D 20/00 132/210 |
| 2011/0021113 | A1 | 1/2011 | Hilfman |
| 2011/0145968 | A1 | 6/2011 | Tolman |
| 2011/0225696 | A1 | 9/2011 | Di Lorenzo |
| 2011/0289646 | A1 | 12/2011 | Scozzafava |
| 2012/0272427 | A1 | 11/2012 | Scozzafava |
| 2012/0276811 | A1 | 11/2012 | Nakajima et al. |
| 2013/0059498 | A1 * | 3/2013 | Hersh ..... A41D 7/00 450/31 |
| 2013/0225043 | A1 | 8/2013 | Musarra-Leonard |
| 2014/0101814 | A1 | 4/2014 | Caulfield et al. |
| 2014/0196188 | A1 | 7/2014 | Brady |
| 2014/0215690 | A1 | 8/2014 | Caulfield et al. |
| 2014/0273737 | A1 | 9/2014 | Cortese et al. |
| 2015/0007374 | A1 | 1/2015 | Larson |
| 2015/0173427 | A1 | 6/2015 | Sawyer |
| 2015/0201686 | A1 | 7/2015 | Gauthier |
| 2015/0237935 | A1 | 8/2015 | Maryea |
| 2016/0037837 | A1 | 2/2016 | Ferrara |
| 2017/0164667 | A1 * | 6/2017 | Street ..... A41D 15/002 |
| 2017/0196283 | A1 * | 7/2017 | Hart ..... A41D 13/0017 |
| 2017/0325519 | A1 * | 11/2017 | Willingham ..... A41D 7/00 |

FOREIGN PATENT DOCUMENTS

| | | |
|---|---|---|
| GB | 425948 | 3/1935 |
| GB | 430790 | 6/1935 |
| GB | 1440786 | 6/1976 |

* cited by examiner

SWIMWEAR WITH INTERCHANGEABLE ITEMS

BACKGROUND

Women's swimwear generally comes in two different styles, a two piece style or a one piece style. Several variants on these styles exist, such as bikini, tankini, monokini, and halterkini styles. Women often desire to wear different types of swimsuits in different situations. For example, a woman may desire to wear a one piece swimsuit to a public pool she expects to be crowded, while preferring to wear a two piece swimsuit to a beach she expects to be quiet. As another example, a woman may desire to wear a one piece swimsuit when she is planning to swim, and may prefer a two piece swimsuit when she is planning to tan on the beach. As a result, many women own several swimsuits. A woman often brings a swimsuit with her expecting a certain situation to exist at a destination, only to be frustrated when the situation is not as expected. For example, a woman might decide to bring a two piece swimsuit to a beach, but might wish she had instead brought a one piece swimsuit upon finding the beach to be crowded.

Women's swimsuits also vary in fashion, such as in color, shape, pattern and/or design. A woman might own several swimsuits so that she may wear different fashions on different occasions, which can get expensive.

Women's swimsuits also vary in terms of comfort. Swimsuits are made with different materials, such as spandex, nylon, cotton, or polyester. Some of these materials may be better suited for some situations than other situations. Some swimsuits may have a tight fitting style designed for swim competitions, while others may be more loose fitting designed for comfort. A woman may need to own many swimsuits for a variety of situations, which can get expensive.

Another frustration experienced by women at a public swimming area is the lack of privacy for changing. A woman at a beach, for example, may swim for a short period of time, then decide she wants to go for a walk on the beach with more clothing on, and then decide she again wants to swim for a bit. It can be frustrating to have to use a public restroom to change in and out of one's clothing when at a public swimming area.

It can also be difficult for a woman to change into, change out of, or otherwise adapt certain swimwear. For example, many styles of swimwear include straps or strings that extend around a woman's back, which can be difficult for a woman to tie, particularly a woman who is limited physically. Additionally, certain swimwear designs may include elements, such as magnets, that can negatively interact with implanted medical devices, such as implanted cardioverter defibrillator (ICD) devices and pacemakers.

U.S. Patent Application Publication No. 2015/0173427 depicts swimwear having a top, a bottom, and a midriff garment attachable with magnetic attachments. Because of the placement of the magnetic attachments under the cups of the top of the swimsuit, the midriff garment is secured around the wearer with fabric ties.

U.S. Pat. No. 8,522,362 relates to maternity swimwear. The patent discusses switching out different midsection covers of large circumference and length to accommodate a pregnant belly as it varies in size. The midsection covers have different average distances between snap members. The midsection cover can also be connected to the swimsuit bottom, which can help to facilitate breastfeeding.

U.S. Pat. No. 8,051,496 relates to convertible swimwear. The swimwear includes a top piece and a bottom piece. The top piece includes a plurality of fasteners along a lower edge and the bottom piece has a plurality of corresponding fasteners along an upper edge. The fasteners of the bottom piece can be releasably secured to fasteners along the lower edge of the top piece. The bottom piece also includes a string component that allows the bottom piece to be rolled, folded, or scrunched. The top piece includes a cover flap to conceal fasteners. The swimsuit could be tight fitting when used as a one piece swimsuit, and might look bulky when rolled, folded or scrunched.

U.S. Patent Application Publication No. 2009/0126072 relates to a two piece swimsuit, where a top piece of the swimsuit can be attached to conservative clothing suitable for running errands and other everyday activities. The conservative clothing can be in the shape of shorts, pants, or a skirt.

U.S. Pat. No. 6,185,741 relates to a swimsuit that can be converted from a one piece swimsuit to a two piece swimsuit. A top piece can be unfastened from a bottom piece to provide convenience to the wearer in using the bathroom. The lower region of the top piece can be unfastened from the bottom piece, folded upward, and fastened behind the wearers back to create a tank top or bikini style. Alternatively, the bottom piece can be folded up over the front of the swimsuit and secured behind the wearers neck to create a one piece style.

U.S. Pat. No. 6,240,560 relates to a swimsuit with accessories. The swimsuit allows for interchangeable attachment of straps, links, and chains to alter the style and appearance of the swimsuit. The wearer can use the interchangeable attachments to achieve various angles of lift on the breasts. The straps, links, and chains can be used to provide different styles, such as a Brazilian cut or thong style. Accessories, such as a skirt, full length gown, maternity gown, sash, or race number panel, can be attached to the swimsuit.

U.S. Pat. No. 6,035,439 relates to a swimsuit with a torso portion that offers coverage of the torso of a wearer. A seat portion is connected to a front of the swimsuit, and can extend through the legs and be releasably fastened and unfastened to the torso portion, providing easy access to the wearer's crotch area.

U.S. Pat. No. 4,815,145 relates to a two piece swimsuit with decorative ruffled tails. The decorative ruffled tails are adapted to be snapped into a bottom piece of the swimsuit. A midriff portion can be secured to a top piece and a bottom piece of the swimsuit.

U.S. Pat. No. 4,656,669 relates to a two piece swimsuit with a sewn in hidden pocket that includes additional swimsuit material. The pocket can contain a shawl or cape to wear over the shoulders. The additional material can be attached to the top and the bottom of the two piece swimsuit.

U.S. Pat. No. 4,301,545 relates to an adjustable two piece swimsuit, where upper and lower pieces of the swimsuit are connected by a triangular material. When the upper piece is disconnected from the lower piece, a flap and a connector are tucked under the lower piece. The connectors allow the upper piece and lower piece to be connected to act as a one piece swimsuit.

U.S. Patent Application Publication No. 2015/0007374 relates to a garment addition for swimwear. The garment addition includes expandable loopholes of stretchable material that allows straps or ties to be threaded through the loopholes. The transferable garment is intended to be form fitting to the wearers body. The garment addition would be difficult to remove, and would likely have to be removed in private.

U.S. Pat. No. 9,706,799 relates to a swimsuit that includes top and bottom portions. The swimsuit includes attachment points on the top and bottom portions for attaching to base layers. For example, a bottom portion can be attached to a base layer similar to a pair of leggings, shorts, or capri pants. The swimsuit may include a buffer of fabric to help reduce or eliminate the discomfort of inner thigh chaffing.

U.S. Patent No. 2016/0037837 relates to a two piece garment, such as a bikini swimsuit or lingerie. A top portion includes fasteners for fastening the top portion to a midriff portion. A bottom portion can also include fasteners for fastening the bottom portion to the midriff portion. When the top portion and the bottom portion are fastened using the fasteners, the garment gives the appearance of a one piece garment.

None of the above patents or patent publications describe the subject matter disclosed herein, or solve all of the problems associated with swimwear as described above.

SUMMARY

Embodiments of the present disclosure relate to clothing articles and clothing ensembles. In addition, embodiments of the present disclosure relate to solutions for changing a clothing style.

In accordance with some embodiments of the present disclosure, there is provided a clothing ensemble comprising a swimsuit top, a swimsuit bottom, and a midriff garment. The swimsuit top comprises fabric shaped into cups for covering a wearer's breasts, wing portions configured to wrap around sides of the wearer, and three attachment members attached to a lower edge of the fabric, wherein one of the attachment members is located between the two cups, one of the attachment members is located on one of the wing portions, and one of the attachment members is located on another of the wing portions. The swimsuit bottom comprises fabric shaped to cover a wearer's groin and buttocks. The midriff garment comprises fabric shaped to cover a wearer's midriff and attachment members configured to fasten to the attachment members of the swimsuit top at attachment points.

In accordance with aspects of the disclosure, the fabric of the midriff garment is a different type of fabric than the fabric of the swimsuit top and the fabric of the swimsuit bottom.

In accordance with further aspects of the disclosure, the clothing ensemble further comprises a covering garment, the covering garment being different than the swimsuit top, the swimsuit bottom, and the midriff garment.

In accordance with still further aspects of the disclosure, the covering garment is configured to be worn as a headscarf.

In accordance with aspects of the disclosure, the covering garment is configured to be worn as a skirt.

In accordance with further aspects of the disclosure, the covering garment is configured for use as a headscarf, and is also configured for use as a skirt.

In accordance with still further aspects of the disclosure, the headscarf garment is designed to match the midriff garment in at least one of pattern, color, or type of fabric.

In accordance with aspects of the disclosure, the midriff garment is not configured to be fastened to the swimsuit bottom.

In accordance with further aspects of the disclosure, the swimsuit top is made of an elastic material, the swimsuit bottom is made of an elastic material, and the midriff garment is not made of an elastic material.

In accordance with still further aspects of the disclosure, the attachment members are one of snaps, hooks, hook and loop fasteners, buttons, or string ties.

In accordance with aspects of the disclosure, the type of fabric of the midriff garment is one of cotton, silk, macramé, or spandex.

In accordance with further aspects of the disclosure, the midriff garment is a first midriff garment, and the clothing ensemble further comprises a second midriff garment. The second midriff garment comprises fabric shaped to cover a wearer's midriff and attachment members configured to fasten to the attachment members of the swimsuit top at attachment points.

In accordance with still further aspects of the disclosure, the second midriff garment differs from the first midriff garment in one or more of pattern, color, type of fabric, or shape.

In accordance with aspects of the disclosure, when the swimsuit top and midriff garment are attached by the attachment members at attachment points and are worn by the wearer, the fabric of the midriff garment droops between the attachment points such that the wearer's skin is visible.

In accordance with further aspects of the disclosure, the swimsuit top further comprises shoulder portions configured to extend over a wearer's shoulders.

In accordance with still further aspects of the disclosure, the swimsuit top does not include any fabric configured to extend over a wearer's shoulders.

In accordance with aspects of the disclosure, the attachment members of the swimsuit top are located on the inside of the swimsuit top, such that they are not visible when the swimsuit top is worn.

BRIEF DESCRIPTION OF THE DRAWINGS

The accompanying drawings, which are incorporated in and constitute part of this specification, and together with the description, illustrate and serve to explain the principles of various example embodiments.

DETAILED DESCRIPTION OF EXAMPLE EMBODIMENTS

Figure 1:
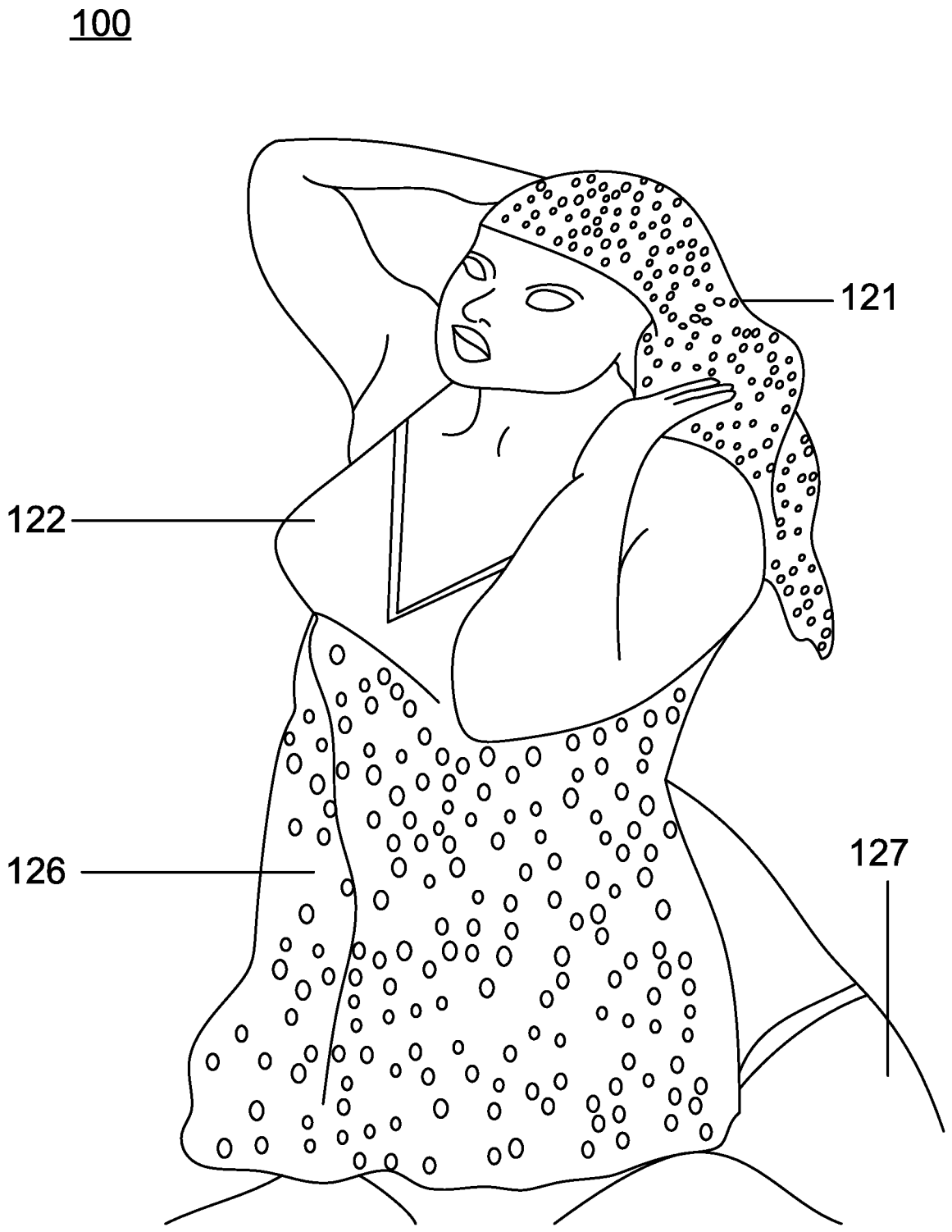
FIG. 1 illustrates an example view of a swimwear ensemble, consistent with embodiments of the present disclosure.

In the following description, numerous specific details are set forth regarding the disclosed subject matter in order to provide a thorough understanding of the disclosed subject matter. It will be apparent to one skilled in the art, however, that the disclosed subject matter may be practiced without such specific details, and that certain features, which are well known in the art, are not described in detail in order to avoid unnecessary complication of the disclosed subject matter. In addition, it will be understood that the embodiments provided below are exemplary, and that it is contemplated that there are other articles of clothing or clothing ensembles that are within the scope of the disclosed subject matter.

Embodiments of the present disclosure relate to clothing and clothing ensembles. In addition, embodiments of the present disclosure relate to solutions for changing a clothing style.

Women's swimwear generally comes in two different styles, a two piece style or a one piece style. Several variants on these styles exist, such as bikini, tankini, monokini, and halterkini styles. Women often desire to wear different types of swimsuits in different situations. For example, a woman may desire to wear a one piece swimsuit to a public pool she expects to be crowded, while preferring to wear a two piece swimsuit to a beach she expects to be quiet. As another example, a woman may desire to wear a one piece swimsuit when she is planning to swim, and may prefer a two piece swimsuit when she is planning to tan on the beach. As a result, many women own several swimsuits. A woman often brings a swimsuit from home expecting a certain situation to exist at a destination, only to be frustrated when the situation is not as expected. For example, a woman might decide to bring a two piece swimsuit to a beach, but might wish she had instead brought a one piece swimsuit upon finding the beach to be crowded.

Women's swimsuits also vary in fashion, such as in color, shape, pattern and/or design. A woman might own several swimsuits so that she may wear different fashions on different occasions, which can get expensive.

Women's swimsuits may also vary in terms of comfort. Swimsuits are made with different materials, such as spandex, nylon, cotton, or polyester. Some of these materials may be better suited for some situations than other situations. Some swimsuits may have a tight fitting style designed for swim competitions, while others may be more loose fitting designed for comfort. A woman may need to own many swimsuits for a variety of situations, which can get very expensive.

Another frustration experienced by women at a public swimming area is the lack of privacy for changing. A woman may at a beach, for example, may swim for a short period of time, then decide she wants to go for a walk on the beach with more clothing on, and then decide she again wants to swim for a bit. It can be frustrating to have to use a public restroom to change in and out of one's clothing when at a public swimming area.

It can also be difficult for a woman to change into, change out of, or otherwise adapt certain swimwear. For example, many styles of swimwear include straps or strings that extend around a woman's back, which can be difficult for a woman to tie, particularly a woman who is limited physically. Additionally, certain swimwear designs may include elements, such as magnets, that can negatively interact with implanted medical devices, such as implanted cardioverter defibrillator (ICD) devices and pacemakers.

Embodiments of the present disclosure can address the problems described above. For example, some embodiments of the present disclosure provide clothing articles or clothing ensembles. In addition, embodiments of the present disclosure relate to solutions for changing a clothing style.

Some embodiments of the present disclosure can address the challenges associated with swimsuits. For example, some embodiments of the present disclosure provide a clothing ensemble that includes a two piece bathing suit with an attachable midriff garment. The clothing ensemble may be configured such that a woman can simply wear the two piece swimsuit by itself, or can attach a midriff garment, depending on the woman's preference. In some embodiments, a woman could select one midriff garment to attach to a swimsuit out of a variety of different midriff garments having different styles, patterns, designs, or fabrics. In doing so, a woman may bring one bathing suit to a destination, and choose to expose more or less of her skin, depending on the situation. A woman can also achieve a variety of different looks while only having to purchase one swimsuit. The clothing ensemble may not require the tying of strings around a wearer's back. The clothing ensemble also may not require the use of magnets or other elements that may interfere with a woman's implanted medical device.

Some embodiments of the present disclosure also address the challenges associated with swimsuits by providing a clothing ensemble that includes a swimsuit top, a swimsuit bottom, a midriff garment, and a covering garment. In some embodiments, the covering garment may be used as a headscarf or skirt. In some embodiments, the covering garment may match the midriff garment in color, pattern, or type of fabric. The covering garment may help a woman to achieve a desired amount of protection from the sun, or a variety of different styles, while only requiring the purchase of one swimsuit.

The term "ensemble" is used herein to refer to a collection of two or more items that are meant to produce a single effect, such as a set of two or more clothing articles that are meant to be worn as a single outfit.

The term "swimsuit top" is used herein to refer to an article of clothing designed for wearing on the upper portion of a torso and made for swimming. A swimsuit top may include fabric shaped into cups for covering a wearer's breasts. A swimsuit top may also include wing portions that extend around a side of the wearer and a back portion that extends around a back of the wearer to secure the swimsuit top around the wearer's torso. The swimsuit top, wing portions, and back portion may be composed of a single loop of fabric. Alternatively, the wing portions can be connected to one another by a fastening member behind the wearer. In some embodiments, a fastening member can be provided between the cups of the swimsuit top for securing the swimsuit top around the wearer's torso. A fastening member may comprise, for example, a snap, hook, hook and loop fastener, button, or string tie. A swimsuit top may also include shoulder straps for securing the swimsuit top to the wearer. A swimsuit top may be made of a fabric that is good for swimming activities, such as spandex, nylon, cotton, or polyester. In some embodiments, the fabric may be elastic. A swimsuit top may be designed to match a swimsuit bottom in one or more of color, pattern, style, and/or fabric.

The term "swimsuit bottom" is used herein to refer to an article of clothing designed for wearing around the waist of a wearer and made for swimming. A swimsuit bottom may include fabric shaped to extend around a wearer's waist, and for covering a wearer's groin and buttocks. The swimsuit bottom may be composed of a single loop of fabric. Alternatively, the front and back of a swimsuit bottom may be secured around the waist of a wearer using one or more fastening members, such as snaps, hooks, hook and loop fasteners, buttons, or string ties. A swimsuit bottom may be made of a fabric that is good for swimming activities, such as spandex, nylon, cotton, or polyester. In some embodiments, the fabric may be elastic. A swimsuit bottom may be designed to match a swimsuit top in one or more of color, pattern, style, and/or fabric.

FIG. 1 illustrates an example view 100 of a swimsuit ensemble, consistent with embodiments of the present disclosure. View 100 illustrates a swimsuit top 122, a swimsuit bottom 127, a midriff garment 126, and a covering garment 121. The swimsuit ensemble is configured such that clothing articles in the ensemble may be worn in various configurations. For example, in one configuration, a woman may wear only swimsuit top 122 and swimsuit bottom 127 as a bikini style swimsuit. In another configuration, a wearer may wear only a swimsuit top 122, a swimsuit bottom 127, and a midriff garment 126 attached to swimsuit top 122. In a further configuration, a wearer may wear only a swimsuit top 122, a swimsuit bottom 127, and a covering garment 121. In still a further configuration, a wearer may wear a swimsuit top 122, a swimsuit bottom 127, a midriff garment 126, and a covering garment 121. In some embodiments, covering garment 121 may be worn as a headscarf or as a skirt. Covering garment 121 may be secured to the wearer's head or waist by tying a portion of covering garment 121 around the wearer's head or waist, respectively.

In some embodiments, midriff garment 126 may be attached to swimsuit top 122 at attachment points (not shown) using attachment members (not shown). Attachment members may include one or more of snaps, hooks, hook and loop fasteners, buttons, or string ties. In some embodiments, midriff garment 126 is configured for attachment to swimsuit top 122, but is not configured for attachment to swimsuit bottom 127. In some embodiments, midriff garment 126 is configured to only attach to the wearer of a swimsuit top 122 via the attachment points. That is, midriff garment 126 may not include any straps or strings for tying around the back of a wearer.

As illustrated in view 100, swimsuit top 122 may have shoulder straps to secure swimsuit top 122 over the wearer's shoulders. Swimsuit top 122 may also have wings that extend around the wearer to secure swimsuit top 122 to the wearer's torso.

A swimsuit ensemble may be configured such that various articles of clothing in the swimsuit ensemble match in one or more of color, pattern, style, or fabric. For example, view 100 illustrates an example swimsuit ensemble where a midriff garment 126 and a covering garment 121 have a matching pattern.

Figure 2:
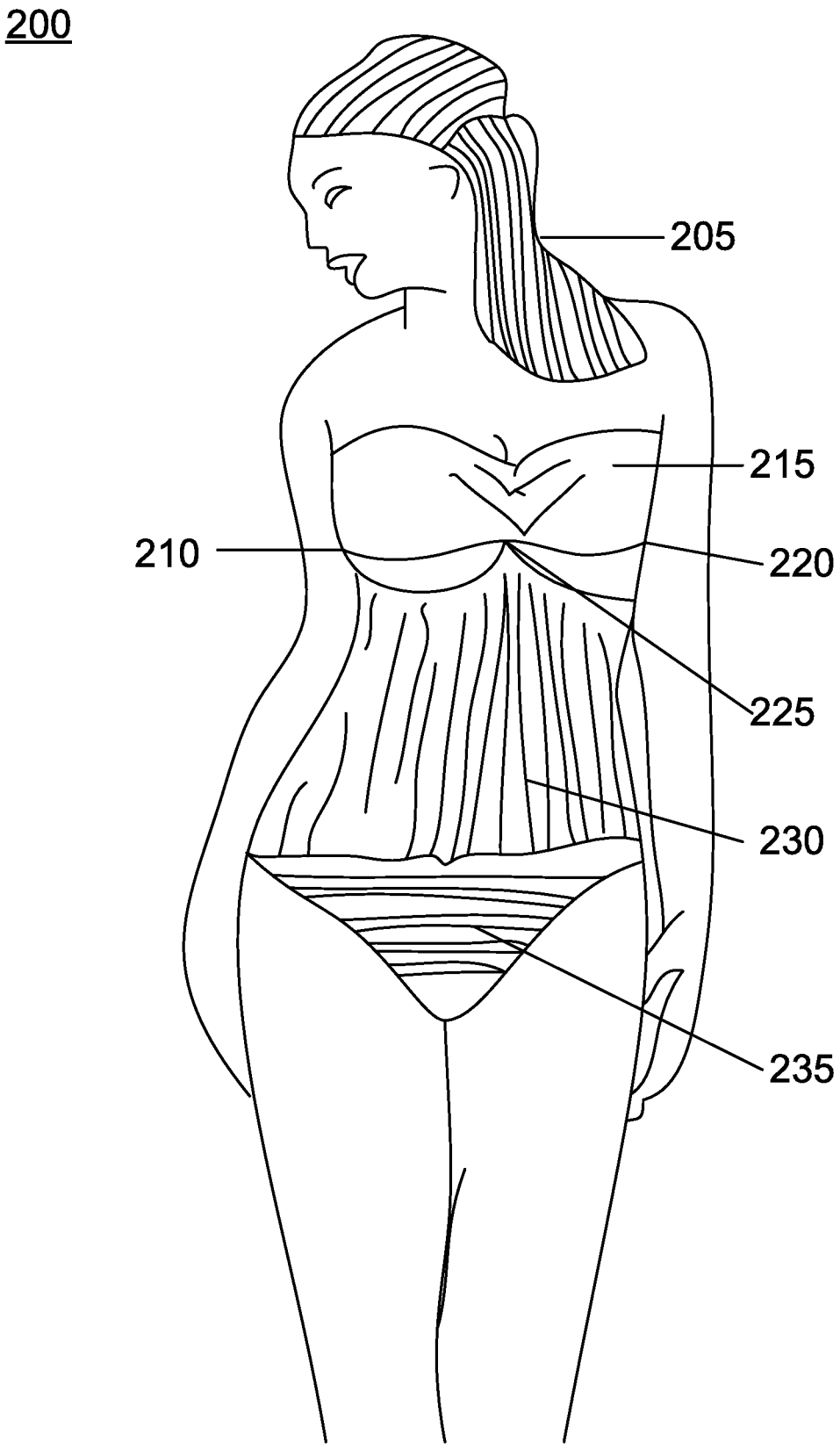
FIG. 2 illustrates another example view of a swimwear ensemble, consistent with embodiments of the present disclosure.

FIG. 2 illustrates another example view 200 of a swimsuit ensemble, consistent with embodiments of the present disclosure. View 200 illustrates a swimsuit top 215, a swimsuit bottom 235, a midriff garment 230, and a covering garment 205. The swimsuit ensemble is configured such that clothing articles in the ensemble may be worn in various configurations. For example, in one configuration a woman may wear only swimsuit top 215 and swimsuit bottom 235 as a bikini style swimsuit. In another configuration, a wearer may wear only a swimsuit top 215, swimsuit bottom 235, and a midriff garment 230 attached to swimsuit top 215. In a further configuration, a wearer may wear only a swimsuit top 215, a swimsuit bottom 235, and a covering garment 205. In still a further configuration, a wearer may wear a swimsuit top 215, a swimsuit bottom 235, a midriff garment 230, and a covering garment 205. In some embodiments, covering garment 205 may be worn as a headscarf or as a skirt. Covering garment 205 may be secured to the wearer's head or waist by tying a portion of covering garment 205 around the wearer's head or waist, respectively.

In some embodiments, midriff garment 126 may be attached to swimsuit top 122 at attachment points via attachment members. Attachment members may include one or more of snaps, hooks, hook and loop fasteners, buttons, or string ties. In some embodiments, midriff garment 126 is configured for attachment to swimsuit top 122, but is not configured for attachment to swimsuit bottom 127. In the example illustrated in view 200, three attachment members are provided on each of swimsuit top 215 and midriff garment 230. Attachment members may be provided on sides of swimsuit top 215 and midriff garment 230, such that when worn by a wearer, swimsuit top 215 and midriff garment 230 attach at an attachment point 210 on a side of the wearer. Attachment members may also attach at another attachment point on the other side of the wearer. In the example illustrated in view 200, an attachment member may be provided between the cups of swimsuit top 215 and another attachment member may be provided at a front portion of midriff garment 230, such that when worn by a wearer, the attachment members of swimsuit top 215 and midriff garment 230 also attach at attachment point 225 at a front side of wearer. In some embodiments, midriff garment 230 is configured to only attach to the wearer of a swimsuit top 215 via the attachment points. That is, midriff garment 230 may not include any straps or strings for tying around the back of a wearer.

In the example illustrated in view 200, only three attachment members are provided on each of swimsuit top 215 and midriff garment 230, such that swimsuit top 215 and midriff garment 230 attach at only three attachment points. In the example illustrated in view 200, the resulting appearance is that the fabric of midriff garment 230 droops between the attachment points such that a portion of the wearer's skin is visible. However, the disclosure is not so limited. Any number of attachment members may be included on swimsuit top 215 and midriff garment 230 for attachment at any number of attachment points.

In some embodiments, a band of fabric may be provided on a bottom of swimsuit top 215 and/or a top of midriff garment 230 for housing attachment members. For example, view 200 illustrates a band 220 for housing attachment members on swimsuit top 215. A corresponding band is provided on midriff garment 230.

As illustrated in view 200, a swimsuit top 215 may not have shoulder straps to secure swimsuit top 215 over the wearer's shoulders. Alternatively, a swimsuit top 215 may have shoulder straps to secure swimsuit top 215 over the wearer's shoulders, as in the example swimsuit top 122 illustrated in view 100 of FIG. 1. Swimsuit top 215 may also have wings that extend around the wearer to secure swimsuit top 215 to the wearer's torso.

A swimsuit ensemble may be configured such that various articles of clothing in the swimsuit ensemble match in one or more of color, pattern, style or fabric. For example, view 200 illustrates an example swimsuit ensemble where a midriff garment 230 and a covering garment 205 have a matching pattern.

Figure 3A:
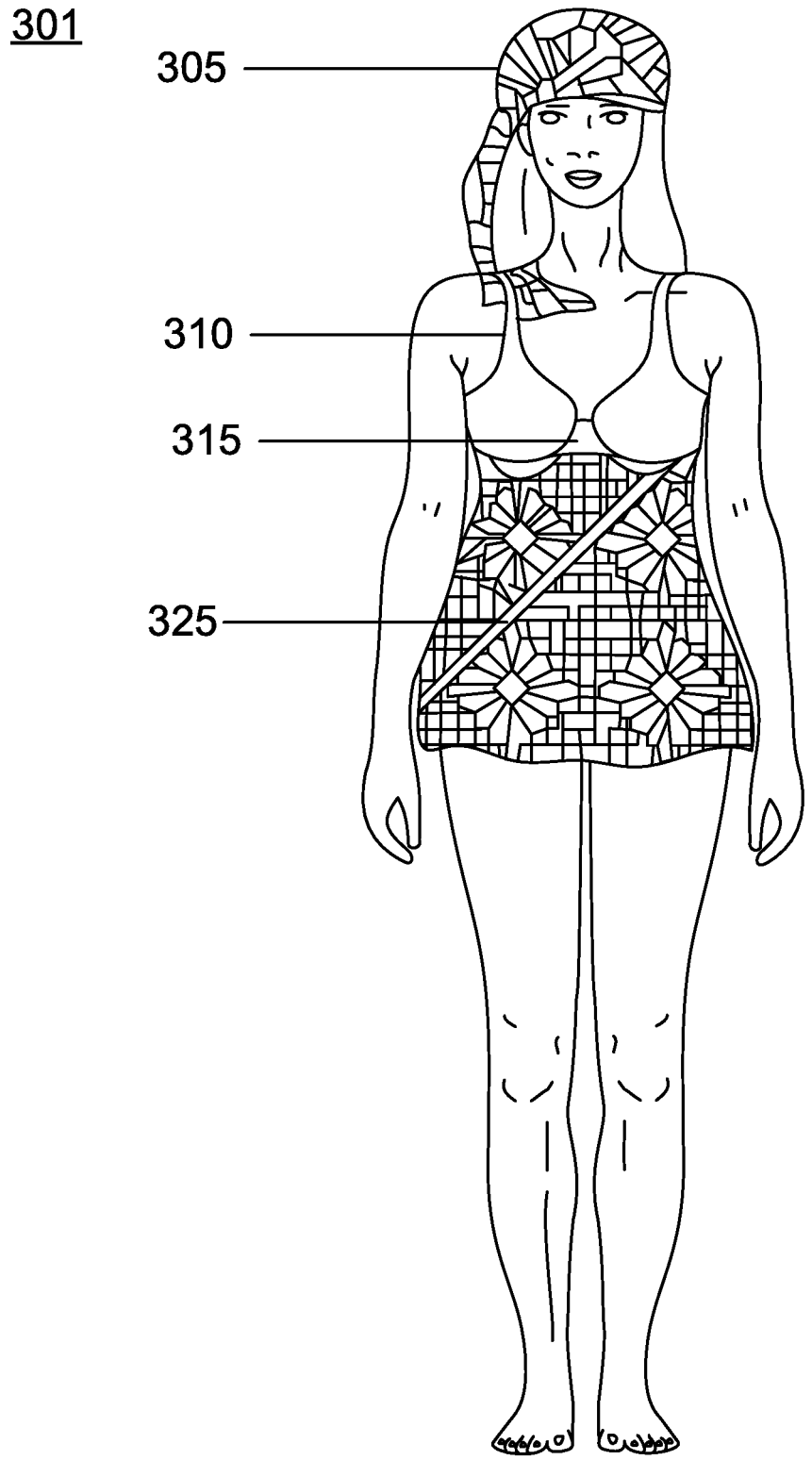
FIG. 3A illustrates an example front view of a swimwear ensemble, consistent with embodiments of the present disclosure.

FIG. 3A illustrates an example front view 301 of a swimsuit ensemble, consistent with embodiments of the present disclosure. View 301 illustrates a swimsuit top 315, a midriff garment 325 covering a swimsuit bottom (not illustrated), and a covering garment 305. The swimsuit ensemble is configured such that clothing articles in the ensemble may be worn in various configurations. For example, in one configuration, a woman may wear only swimsuit top 315 and swimsuit bottom (not illustrated) as a bikini style swimsuit. In another configuration, a wearer may wear only a swimsuit top 315, a swimsuit bottom (not illustrated), and a midriff garment 325 attached to swimsuit top 315. In a further configuration, a wearer may wear only a swimsuit top 315, a swimsuit bottom (not illustrated), and a covering garment 305. In still a further configuration, a wearer may wear a swimsuit top 315, a swimsuit bottom (not illustrated), a midriff garment 325, and a covering garment 305. In some embodiments, covering garment 305 may be worn as a headscarf or as a skirt. Covering garment 305 may be secured to the wearer's head or waist by tying a portion of covering garment 305 around the wearer's head or waist, respectively.

In some embodiments, midriff garment 325 may be attached to swimsuit top 315 via attachment members at attachment points. Attachment members may include one or more of snaps, hooks, hook and loop fasteners, buttons, and string ties. In some embodiments, midriff garment 325 is configured for attachment to swimsuit top 315, but is not configured for attachment to the swimsuit bottom (not illustrated). In the example illustrated in view 301, three attachment members are provided on each of swimsuit top 315 and midriff garment 325. Attachment members may be provided on sides of swimsuit top 315 and midriff garment 325, such that when worn by a wearer, swimsuit top 315 and midriff garment 325 attach at attachment points on sides of the wearer. In the example illustrated in view 301, an attachment member may be provided between the cups of swimsuit top 315 and another attachment member may be provided at a front portion of midriff garment 325, such that when worn by a wearer, attachment members of swimsuit top 315 and midriff garment 325 attach at an attachment point at a front side of wearer.

In the example illustrated in view 301, only three attachment members are provided on each of swimsuit top 315 and midriff garment 325, such that swimsuit top 215 and midriff garment 230 attach at only three attachment points. In the example illustrated in view 301, the resulting appearance is that the fabric of midriff garment 325 droops between the attachment points such that a portion of the wearer's skin is visible. However, the disclosure is not so limited. Any number of attachment members may be provided on swimsuit top 315 and midriff garment 325 for attachment at any number of attachment points.

As illustrated in view 301, swimsuit top 315 may have shoulder straps 310 to secure swimsuit top 315 over the wearer's shoulders. Swimsuit top 315 may also have wings that extend around the wearer to secure swimsuit top 315 to the wearer's torso.

A swimsuit ensemble may be configured such that various articles of clothing in the swimsuit ensemble match in one or more of color, pattern, style, or fabric. For example, view 301 illustrates an example swimsuit ensemble where a midriff garment 325 and a covering garment 305 have a matching pattern.

Figure 3B:
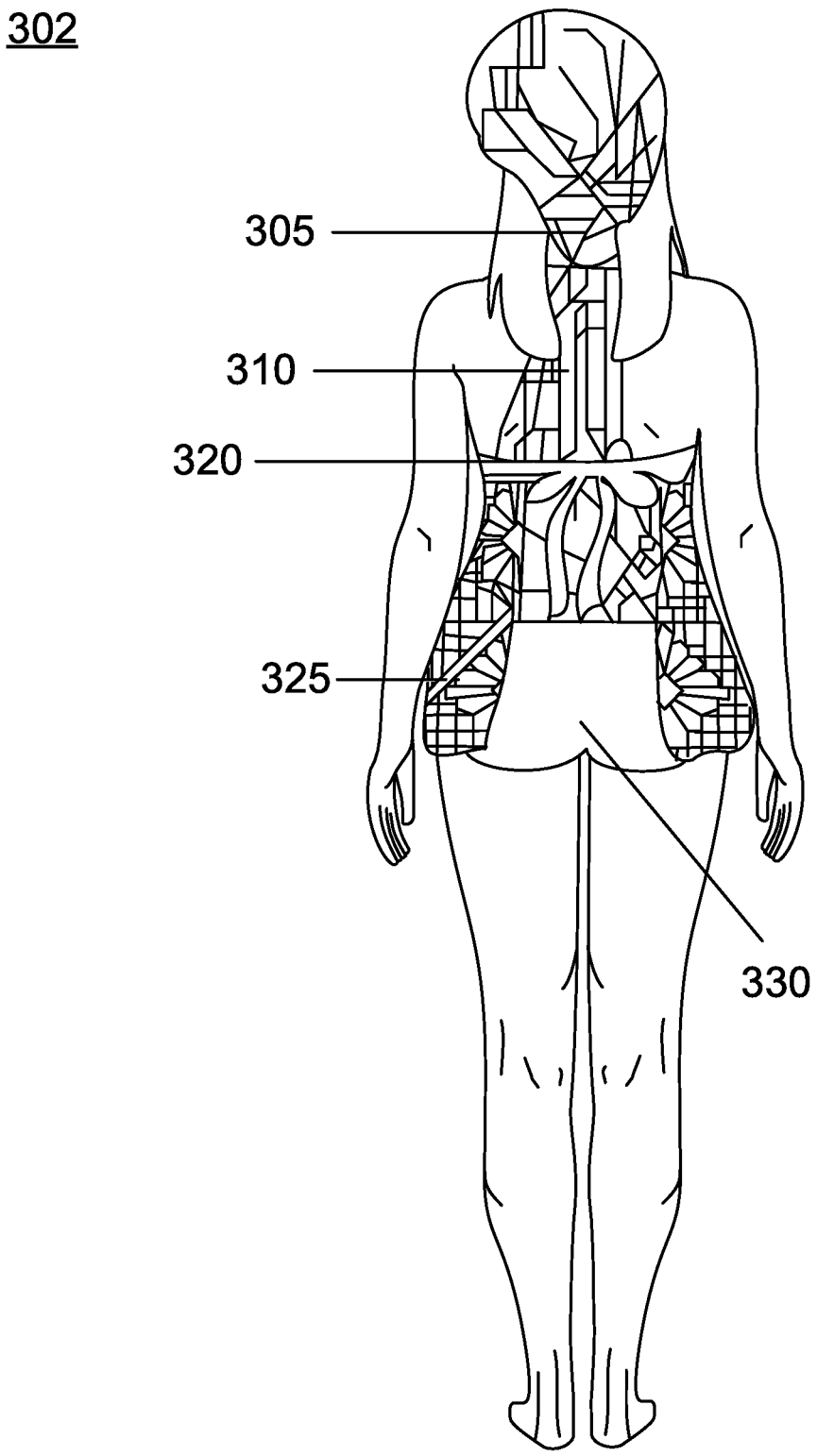
FIG. 3B illustrates an example back view of a swimwear ensemble, consistent with embodiments of the present disclosure.

FIG. 3B illustrates an example back view 302 of the swimsuit ensemble illustrated in view 301 of FIG. 3A. View 302 illustrates the back side of swimsuit top 320, swimsuit bottom 330, midriff garment 325, and covering garment 305. In the example illustrated in view 302, swimsuit top 320 is secured to the wearer's torso with string ties on the back of swimsuit top 320. In view 302, shoulder straps 310 are tied behind the neck of the wearer for securing swimsuit top 320 to the wearer's shoulders.

As shown in view 302, midriff garment 325 may be designed such that, when attached to swimsuit top 320 and worn by a wearer, the back of the wearer is not covered by midriff garment 325. As shown in view 302, midriff garment 325 may not include any ties or strings for tying midriff garment 325 to the wearer. Rather, midriff garment 325 may only be secured to the wearer by way of attachment of attachment members at the attachment points.

Figure 3C:
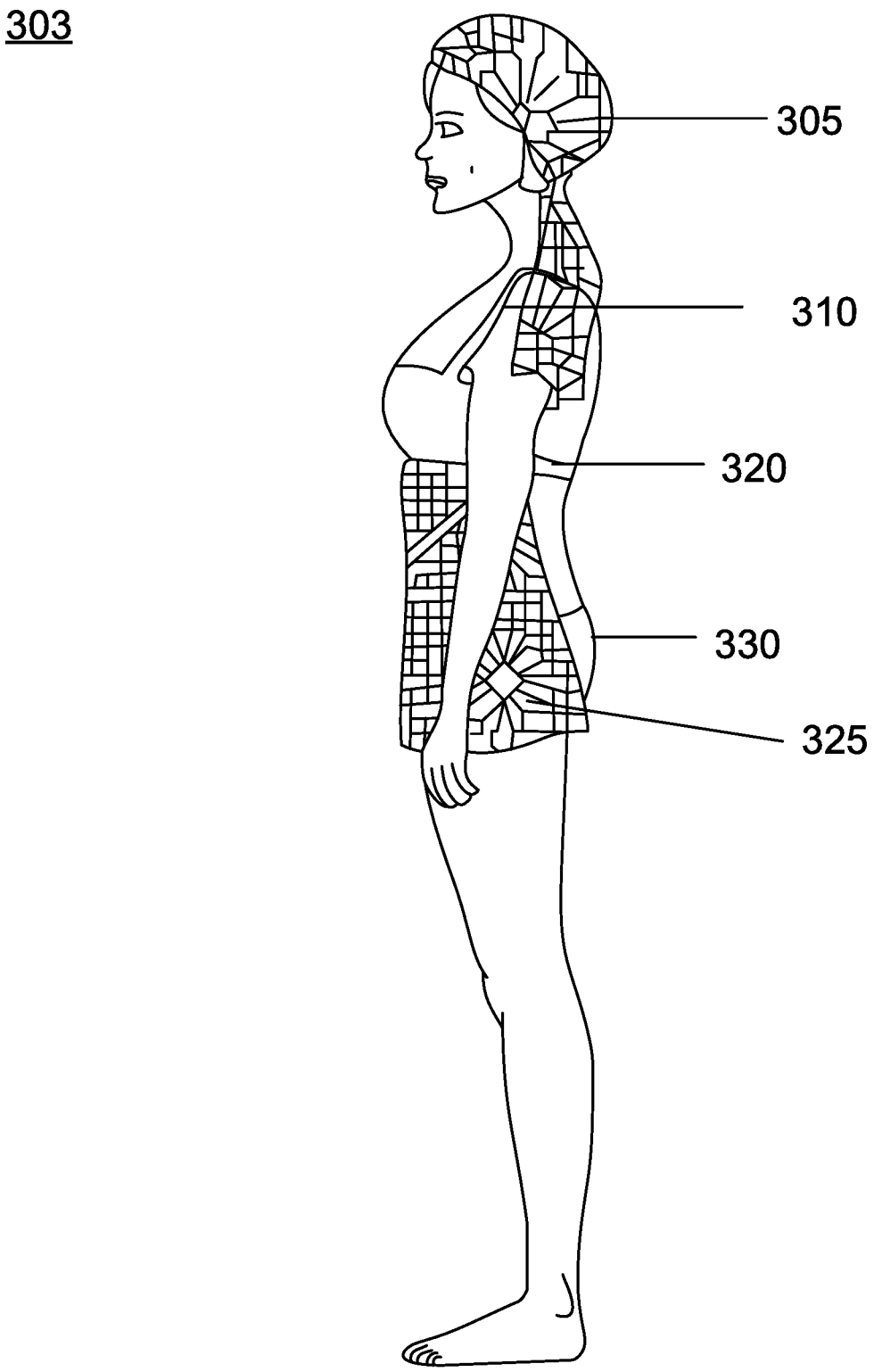
FIG. 3C illustrates an example side view of a swimwear ensemble, consistent with embodiments of the present disclosure.

FIG. 3C illustrates an example side view 303 of the swimsuit ensemble illustrated in view 301 of FIG. 3A and in view 302 of FIG. 3B. View 303 illustrates the side view of swimsuit top 320, swimsuit bottom 330, midriff garment 325, and covering garment 305.

Figure 4A:
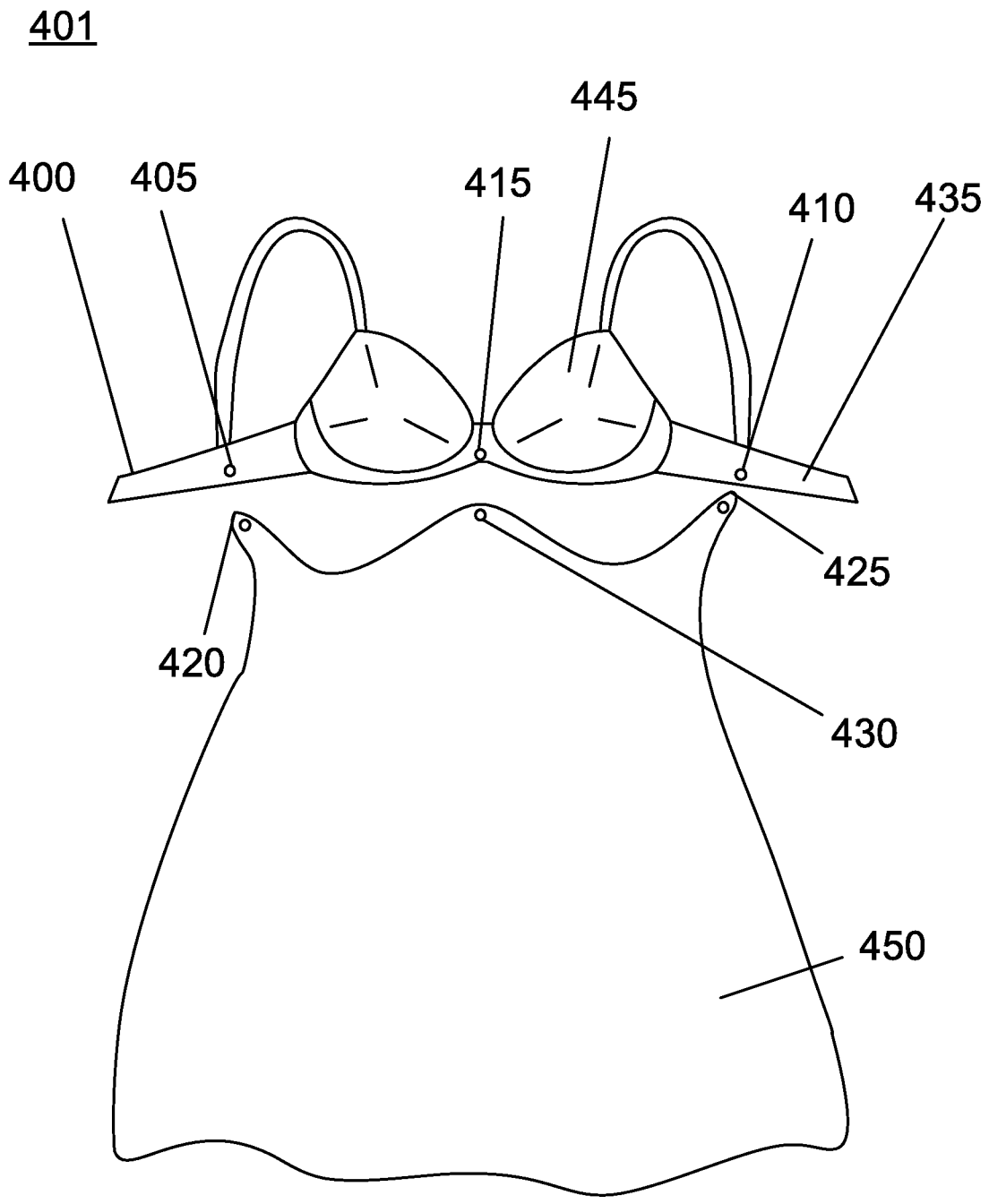
FIG. 4A illustrates an example view of an attached swimsuit top and midriff garment, consistent with embodiments of the present disclosure.

FIG. 4A illustrates an example view 401 of a swimsuit top 445 and a midriff garment 450, consistent with embodiments of the present disclosure. As shown in view 401, midriff portion may include three attachment members. One attachment member 420 may be located on a side of midriff garment 450, and another attachment member 425 may be located on the other side of midriff garment 450. A third attachment member may be located in the center of midriff garment 430.

As shown in example view 401, swimsuit top 445 may also include three attachment members. One attachment member 405 may be located on wing portion 440 of swimsuit top 445. Another attachment member 410 may be located on wing portion 435 of swimsuit top 445. A third attachment member 415 may be located in the center of swimsuit top 445, between the cups of swimsuit top 445.

Figure 4B:
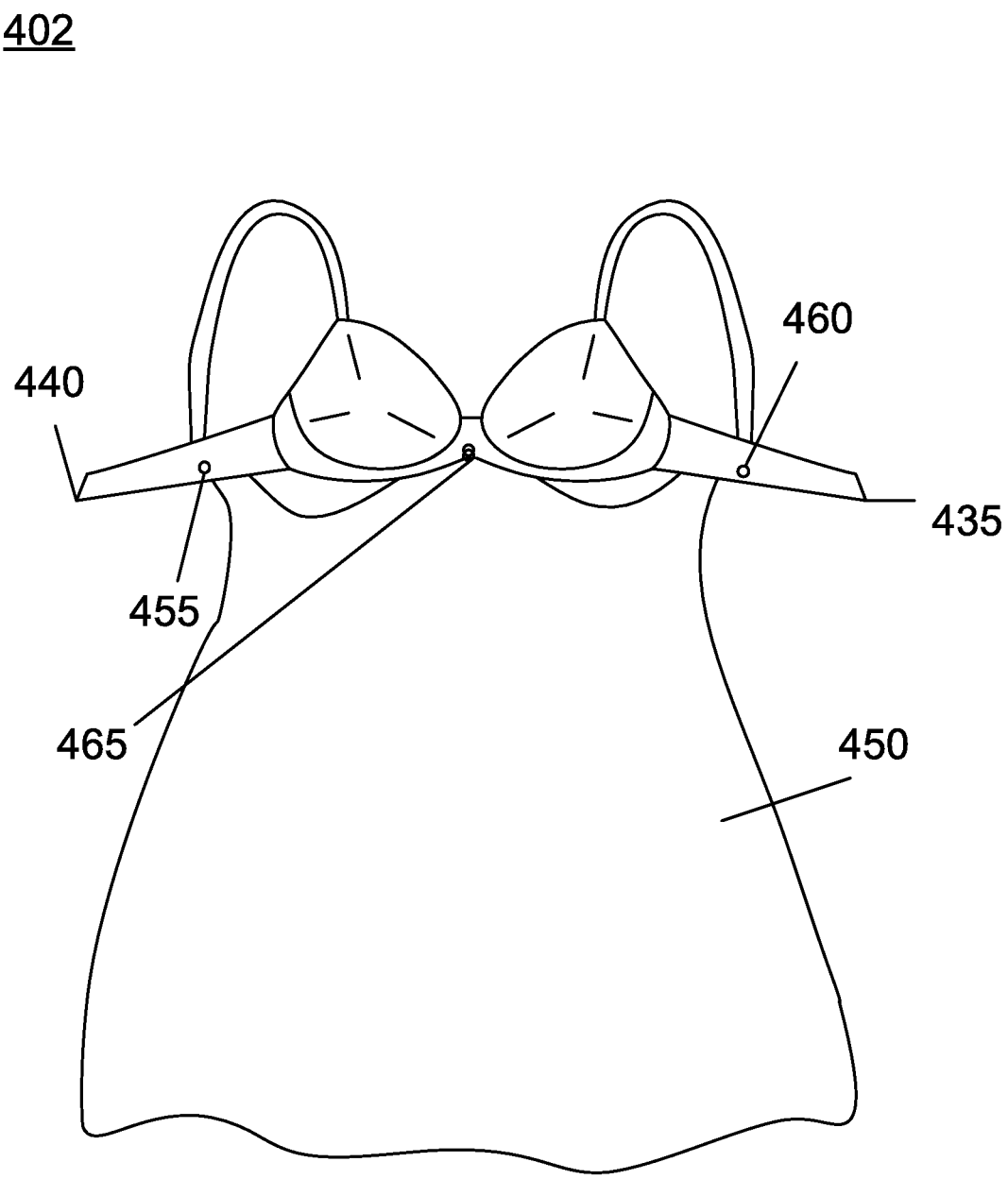
FIG. 4B illustrates an example view of an unattached swimsuit top and midriff garment, consistent with embodiments of the present disclosure.

FIG. 4B illustrates an example view 402 of the same swimsuit top 445 and midriff garment 450 of view 401 of FIG. 4A, consistent with embodiments of the present disclosure. As shown in view 402, the attachment members of swimsuit top 445 and midriff garment 450 may be attached at three attachment points. One attachment point 455 could be the result of the attachment of attachment member 420 of view of 401 of FIG. 4A and attachment member 405 of view 401 of FIG. 4A. Another attachment point 460 could be the result of the attachment of attachment member 425 of view 401 of FIG. 4A and attachment member 410 of view 401 of FIG. 4A. A third attachment point 465 could be the result of the attachment of attachment member 430 of view 401 of FIG. 4A and attachment member 415 of view 401 of FIG. 4A. As shown in example view 402, when the attachment members are attached at the three attachment points, the fabric of midriff garment 450 may droop such that portions of the wearer's skin (beneath the cups) is visible.

Figure 5C:
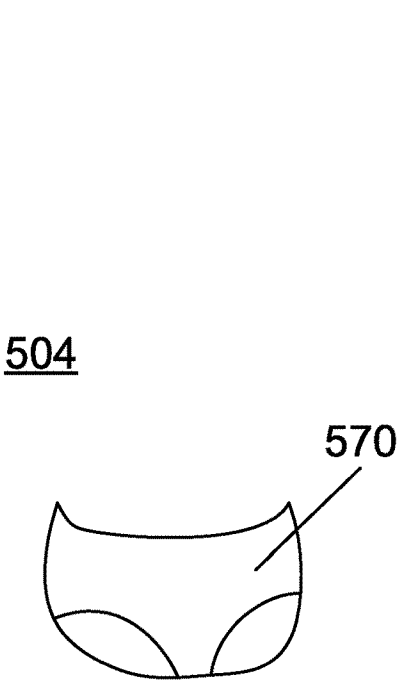
FIG. 5C illustrates an example view of a swimsuit bottom, consistent with embodiments of the present disclosure.
Figure 5B:
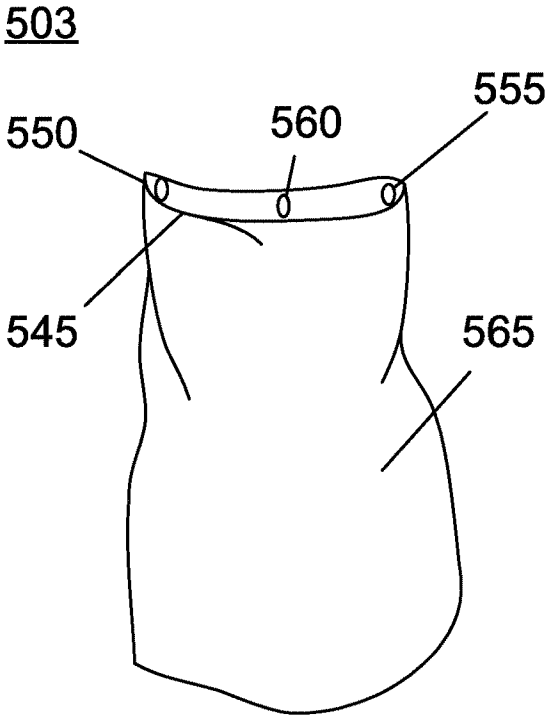
FIG. 5B illustrates an example view of a midriff garment, consistent with embodiments of the present disclosure.
Figure 5A:
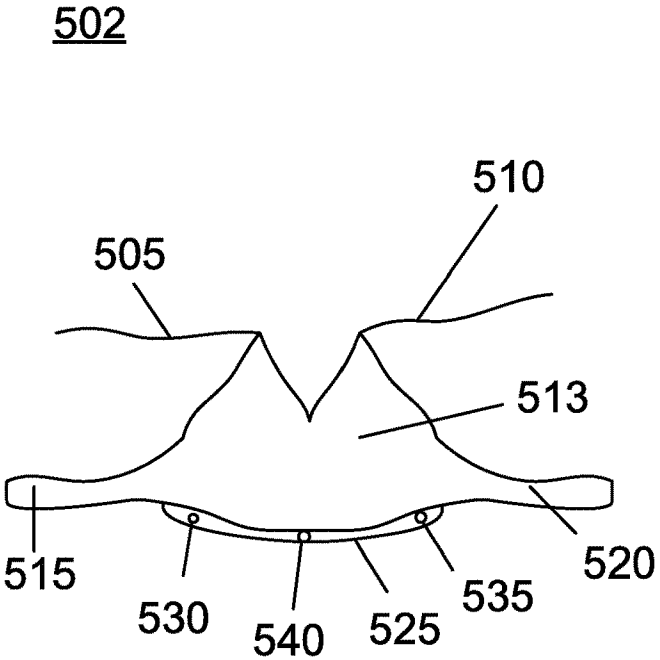
FIG. 5A illustrates an example view of a swimsuit top, consistent with embodiments of the present disclosure.

FIG. 5A illustrates an example view 502 of a swimsuit top 513, consistent with embodiments of the present disclosure. As shown in view 502, swimsuit top 513 may include shoulder straps 505 and 510 for securing swimsuit top 513 to a wearer's shoulders. Swimsuit top 513 may also include wing portions 515 and 520 for securing swimsuit top 513 to a wearer's torso. Swimsuit top 513 may further include a fabric band 525 for housing attachment members. As shown in view 502, swimsuit top 513 may include three attachment members, attachment member 530, attachment member 535, and attachment member 540.

FIG. 5B illustrates an example view 503 of a midriff garment 565, consistent with embodiments of the present disclosure. Midriff garment 565 may include a fabric band 545 for housing attachment members. As shown in view 503, midriff garment 565 may include three attachment members, attachment member 550, attachment member 555, and attachment member 560. Attachment member 550 may be configured for attachment with attachment member 530 of view 502 of FIG. 5A. Attachment member 555 may be configured for attachment with attachment member 535 of view 502 of FIG. 5A. Attachment member 560 may be configured for attachment with attachment member 504 of view 502 of FIG. 5A.

FIG. 5C illustrates an example view 504 of a swimsuit bottom 570, consistent with embodiments of the present disclosure.

Figure 5D:
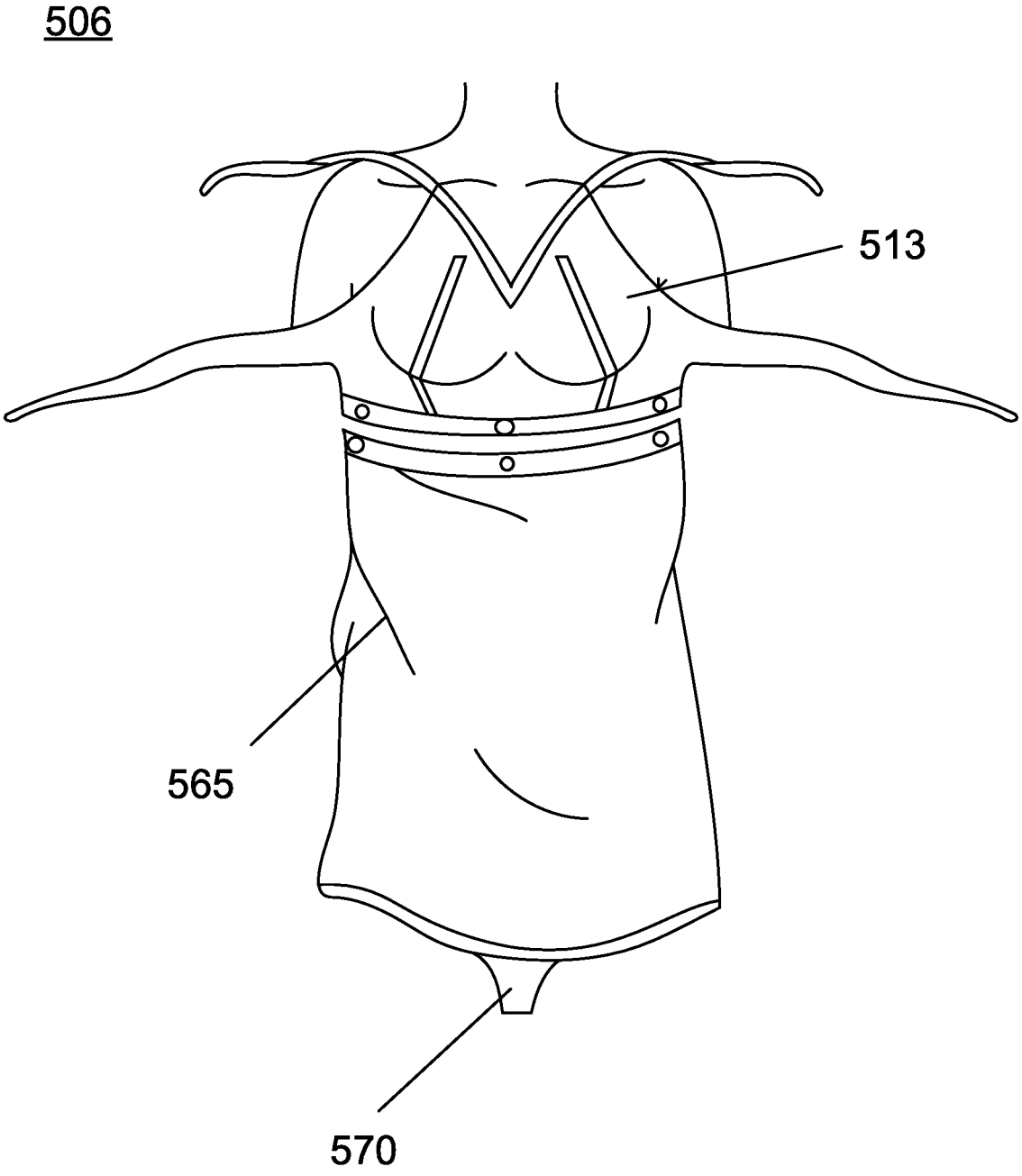
FIG. 5D illustrates an example view of a swimsuit ensemble before a swimsuit top and a midriff garment are attached, consistent with embodiments of the present disclosure.

FIG. 5D illustrates an example view 506 of the same swimsuit top 513, midriff garment 565, and swimsuit bottom 570 illustrated in views 502, 503, and 504 of FIGS. 5A, 5B, and 5C, respectively, as they are being placed on a wearer. View 506 illustrates how attachment members 530, 535, and 540 align with attachment members 550, 555, and 560, respectively, for attachment of swimsuit top 513 to midriff garment 565.

Figure 6C:
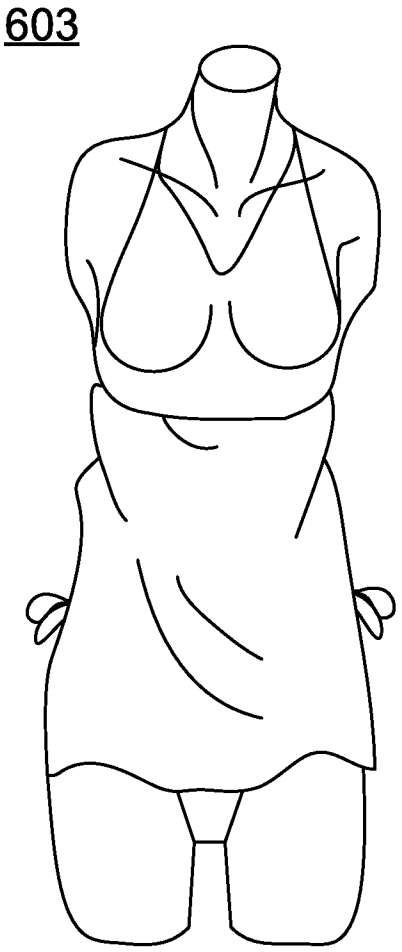
FIG. 6C illustrates an example front view of a swimsuit ensemble where a swimsuit top and a midriff garment are attached, consistent with embodiments of the present disclosure.
Figure 6B:
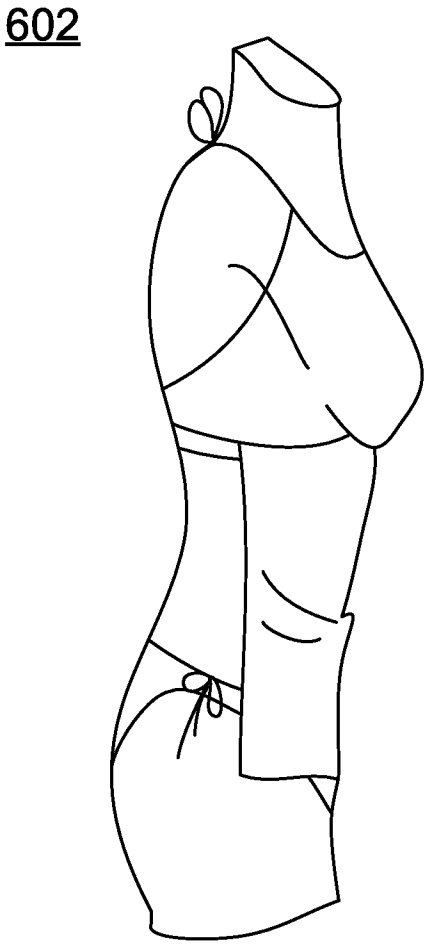
FIG. 6B illustrates an example side view of swimsuit ensemble where a swimsuit top and a midriff garment are attached, consistent with embodiments of the present disclosure.
Figure 6A:
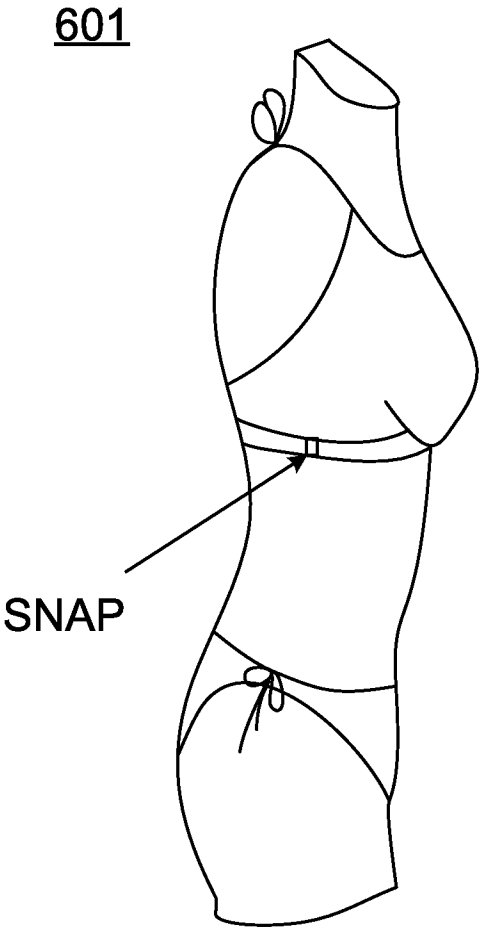
FIG. 6A illustrates an example side view of a swimsuit top and a swimsuit bottom, consistent with embodiments of the present disclosure.

FIG. 6A illustrates an example side view 601 of a swimsuit top and a swimsuit bottom as they might fit a wearer, consistent with embodiments of the present disclosure. As shown in view 601, an attachment member, in this case a snap, is illustrated on the side of the swimsuit top.

FIG. 6B illustrates an example side view 602 of a swimsuit top, a swimsuit bottom, and a midriff garment as they might fit a wearer, consistent with embodiments of the present disclosure. As shown in view 602, the midriff garment is attached to the swimsuit top at attachment points.

FIG. 6C illustrates an example front view 603 of a swimsuit top, a swimsuit bottom, and a midriff garment as they might fit a wearer, consistent with embodiments of the present disclosure. As shown in view 603, the midriff garment is attached to the swimsuit top attachment points. Unlike in views 200, 301-303, and 402, in views 602 and 603 the fabric of the midriff garment does not droop between attachment points. In some embodiments, this could be the result of the use of more than three attachment members on each of the swimsuit top and the midriff garment, such that the swimsuit top and the midriff garment attach at greater than three attachment points. In other embodiments, this could be the result of the use of a one or more attachment members on the swimsuit top and midriff garment that are long strips of fastening material, such as long strips of hook and loop fasteners. In still other embodiments, this could be the result of the use of a midriff garment that is made of a heavier or more rigid fabric.

The embodiments of the present disclosure discussed herein address the challenges associated with conventional swimsuits. By providing a swimsuit top with attachment members, and an attachable and detachable midriff garment, a person can bring one swimsuit to a destination that is re-configurable to be suitable for a variety of situations. Moreover, a person is easily able to reconfigure the swimsuit by attaching or detaching midriff garments, without the need to find a private place to do so. Any type of fabric, pattern, or design of midriff garment may be attached to a swimsuit top with attachment members. As a result, a person can pick a midriff garment based on her preference for use, comfort, design, style, or function. For example, a person might pick a tight fitting midriff garment made of spandex for swimming. A person might instead pick a loose fitting linen midriff garment for a walk on the beach. A person might pick a midriff garment made of a material that offers protection from ultraviolet rays when out in the middle of the day. A person might pick a midriff garment with bold designs or patterns when she wishes to make a fashion statement. A person could pair a covering garment with the swimsuit ensemble when she wishes to complement her fashion statement with the covering garment, or when she desired additional protection from the sun. The result is that a single swimsuit is reconfigurable into many different ways for many different purposes.

Midriff garments can be made of all different shapes, lengths, and sizes. For example, midriff garments can be made for younger girls or grown women. Midriff garments can be made of a length that extends to the swimsuit bottom, can be made of a length that extends all the way to the ground, or anywhere in between.

Attachment members could be any of many types of attachment members, such as snaps, hooks, hook and loop fasteners, buttons, or string ties. In some embodiments, magnets are not used as attachment members as they may interfere with implanted medical devices, such as implantable cardioverter defibrillators (ICDs). Although specific examples are provided herein using three attachment members on each of the swimsuit top and the midriff garment, the disclosure is not so limited. Any number of attachment members may be used for attaching the midriff garment to the swimsuit top at any number of attachment points. In some embodiments, attachment members may be provided on the top sides and top center of the midriff garment. In some embodiments, attachment members may be provided on the bottom of a swimsuit top at the wings and between the cups. In some embodiments, the attachment members of the swimsuit top may have a spacing between them that roughly corresponds to the spacing between the attachment members of a midriff garment. Attachment members may be provided on the inside of a swimsuit top such that, when worn by a wearer, the attachment members are not visible.

A swimsuit top and a swimsuit bottom may be made of any one or more of a variety of materials, such as spandex, nylon, cotton, or polyester. In some embodiments, the material may be elastic. In some embodiments, a swimsuit top and a swimsuit bottom are made of a material that is comfortable for swimming. In some embodiments, a swimsuit top and a swimsuit bottom are made of the same material. In some embodiments, a swimsuit top and a swimsuit bottom match in one or more of pattern, color, design, or style.

A midriff garment may be made of any one or more of a variety of materials, such as spandex, nylon, cotton, polyester, silk, macramé, or linen. In some embodiments, a midriff garment is made of a different material than a swimsuit top and a swimsuit bottom. In some embodiments, a midriff garment does not match a swimsuit top and a swimsuit bottom in one or more of color, pattern, design, or style. In some embodiments, a midriff garment does match a swimsuit top and a swimsuit bottom in one or more of color, pattern, design, or style. In some embodiments, a midriff garment is configured for attachment to a swimsuit top, but is not configured for attachment to a swimsuit bottom.

A covering garment may be made of any one or more of a variety of materials, such as spandex, nylon, cotton, polyester, silk, macramé, or linen. In some embodiments, a covering garment is made of a different material than a swimsuit top and a swimsuit bottom. In some embodiments, a covering garment is made of the same material as a midriff garment. In some embodiments, a covering garment does not match a swimsuit top and a swimsuit bottom in one or more of color, pattern, design, or style. In some embodiments, a covering garment does match a swimsuit top and a swimsuit bottom in one or more of color, pattern, design, or style. In some embodiments, a covering garment does not match a swimsuit top and a swimsuit bottom in one or more of color, pattern, design, or style, but does match a midriff garment in one or more of color, pattern, design, or style.

Consistent with embodiments of the disclosure herein, a variety of different midriff garments may be attached and detached from a swimsuit top. Consistent with embodiments of the disclosure herein, a variety of different covering garments may be paired with a swimsuit. One or more midriff garments and/or covering garments could, for example, be sold with a swimsuit having suitable attachment members. In some embodiments, once a person has purchased a swimsuit having suitable attachment members, the person could later purchase various different midriff garments and/or covering garments for pairing with the swimsuit.

It is to be understood that the disclosed subject matter is not limited in its application to the details of construction and to the arrangements of the components set forth in the foregoing description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter, which is limited only by the claims which follow.

What is claimed is:

1. A clothing ensemble comprising:

a swimsuit top comprising:

fabric shaped into two cups joined by fabric forming a bridge therebetween and configured to cover a wearer's breasts;

fabric forming wing portions extending from an outer side edge of each of the cups and configured to wrap around opposite sides of the wearer and to thereby secure the swimsuit top to the wearer's torso; and three attachment members, wherein: a first one of the attachment members is attached to a lower edge of the fabric forming the bridge and centered between the two cups, a second one of the attachment members is attached to an edge of the fabric forming a left one of the wing portions, and a third one of the attachment members is attached to an edge of the fabric forming a right one of the wing portions;

a swimsuit bottom comprising fabric shaped to cover a wearer's groin and buttocks; and a midriff garment comprising:

fabric shaped to cover a wearer's midriff having an upper edge and a lower edge; and three mating attachment members configured to attach to the attachment members along the fabric at the upper edge of the fabric, the attachment members configured to fasten to the attachment members of the swimsuit top, the lower edge of the fabric being configured to be free of any means of attachment to thereby permit the lower edge to drape freely.

2. The clothing ensemble of claim 1, wherein the fabric of the midriff garment is a different type of fabric than the fabric of the swimsuit top and the fabric of the swimsuit bottom.

3. The clothing ensemble of claim 1, further comprising a covering garment, the covering garment being made from a fabric of a different type than the type of fabric of the swimsuit top, the swimsuit bottom, and the midriff garment.

4. The clothing ensemble of claim 3, wherein the covering garment is configured for use as a headscarf and is also configured for use as a skirt.

5. The clothing ensemble of claim 3, wherein the type of fabric of the covering garment matches the type of fabric of the midriff garment.

6. The clothing ensemble of claim 1, wherein the midriff garment is configured to drape freely over the swimsuit bottom.

7. The clothing ensemble of claim 1, wherein the swimsuit top is made of an elastic material, the swimsuit bottom is made of an elastic material, and the midriff garment is not made of an elastic material.

8. The clothing ensemble of claim 1, wherein the attachment members are one of snaps, hooks, hook and loop fasteners, buttons, or string ties.

9. The clothing ensemble of claim 1, wherein the type of fabric of the midriff garment is one of cotton, silk, macrame, or spandex.

10. The clothing ensemble of claim 1, wherein the midriff garment is a first midriff garment, further comprising:

a second midriff garment comprising:

fabric shaped to cover a wearer's midriff, the fabric bearing a color, pattern, design, or style that is different from the color, pattern, design, or style of the first midriff garment; and attachment members configured to fasten to the attachment members of the swimsuit top.

11. The clothing ensemble of claim 10, wherein the second midriff garment differs from the first midriff garment in one or more of type of fabric, or shape.

12. The clothing ensemble of claim 1, wherein the fabric of the midriff garment is configured to droop between the attachment points such that the wearer's skin is visible when the swimsuit top and midriff garment are attached by the attachment members and are worn by a wearer.

13. The clothing ensemble of claim 1, wherein the attachment members of the swimsuit top are located on the inside of the swimsuit top, such that the attachment members of the swimsuit top are not visible when the swimsuit top is worn.

14. The clothing ensemble of claim 1, wherein the covering garment is a headband.

15. The clothing ensemble of claim 1, wherein the covering garment is a headscarf.

* * * * *